US007684586B2

(12) United States Patent
Shimamura

(10) Patent No.: US 7,684,586 B2
(45) Date of Patent: Mar. 23, 2010

(54) DUAL VOICE COIL SPEAKER

(75) Inventor: Naoki Shimamura, Iwaki (JP)

(73) Assignee: Alpine Electronics, Inc., Tokyo (JP)

( * ) Notice: Subject to any disclaimer, the term of this patent is extended or adjusted under 35 U.S.C. 154(b) by 1217 days.

(21) Appl. No.: 11/233,400

(22) Filed: Sep. 22, 2005

(65) Prior Publication Data

US 2006/0067558 A1 Mar. 30, 2006

(30) Foreign Application Priority Data

Sep. 29, 2004 (JP) ..... 2004-284934
Sep. 30, 2004 (JP) ..... 2004-286484

(51) Int. Cl.
*H04R 1/00* (2006.01)
*H04R 9/06* (2006.01)

(52) U.S. Cl. ..... 381/401; 381/398

(58) Field of Classification Search ..... 381/396, 381/398, 401, 424; 181/171, 172, 173

See application file for complete search history.

(56) References Cited

U.S. PATENT DOCUMENTS 3,665,124 A * 5/1972 Sotome ..... 381/401
4,438,297 A 3/1984 Kawamura

FOREIGN PATENT DOCUMENTS

JP S53-163120 U 12/1978
JP S59-004297 1/1984

* cited by examiner

*Primary Examiner*—Brian Ensey
(74) *Attorney, Agent, or Firm*—Brinks Hofer Gilson & Lione

(57) ABSTRACT

A speaker includes a diaphragm having a principal vibration part and annular internal and external supports for supporting the principal vibration part, a large-diameter voice coil unit mounted at the outer edge of the principal vibration part, a small-diameter voice coil unit mounted at the inner edge of the principal vibration part, and a yoke integrated with the diaphragm. Positioning members fixed to the diaphragm as well as secured to a predetermined site of the yoke are provided for restricting the positions of the diaphragm relative to the yoke in a radial direction and an axial direction perpendicular to the radial direction so that the large-diameter voice coil unit and the small-diameter voice coil unit are arranged within respective magnetic gaps in a magnetic circuit.

11 Claims, 6 Drawing Sheets

DUAL VOICE COIL SPEAKER

BACKGROUND OF THE INVENTION

1. Field of the Invention

The present invention relates to speakers for use in an acoustic system, and in particular relates to a speaker having two voice coils arranged coaxially with diameters different from each other, and a manufacturing method therefor.

2. Description of the Related Art

A so-called double voice speaker having two voice coils has been proposed (see U.S. Pat. No. 4,438,297, for example). In such a speaker, a voice coil with a small diameter and a voice coil with a large diameter are coaxially mounted on a diaphragm made of paper or cloth. The diaphragm is integrated with a magnetic circuit comprising a yoke and a magnet fixed to the yoke so that the voice coil with the small diameter and the voice coil with the large diameter are arranged within magnetic gaps in the magnetic circuit. In a speaker with such a structure, the diaphragm is vibrated by both the voice coil with the small diameter and the voice coil with the large diameter to which an audio signal is supplied so as to generate a sound corresponding to the audio signal. With such a speaker, the voice coil with the small diameter has charge of a sound with a comparatively high frequency band while the voice coil with the large diameter has charge of a sound with a comparatively low frequency band, thereby generating a sound with a wide frequency band.

In the speaker with the structure described above, the magnetic gap in the magnetic circuit comprising the yoke and the magnet fixed to the yoke is generally narrow, and the diaphragm must be integrated with the yoke so that the voice coil with the small diameter and the voice coil with the large diameter are appropriately arranged in their respective magnetic gaps. However, the diaphragm made of paper or cloth is liable to deform in the radial direction and in an axial (front-back) direction of the speaker perpendicular to the radial direction. Hence, it is difficult to integrate the diaphragm with the yoke so that the voice coil with the small diameter and the voice coil with the large diameter are appropriately arranged in their respective magnetic gaps.

Also, in the speaker with the structure described above, since the vibration by the voice coil with the small diameter and the vibration by the voice coil with the large diameter are applied to a common diaphragm, the respective vibrations interfere with each other so that a sound with a specific frequency band may be distorted, or a phenomenon may occur in that a resonance is generated so that an acoustic pressure level protrudes at a specific frequency band, as shown within the broken line in FIG. 9.

SUMMARY OF THE INVENTION

The present invention has been made in view of such situations, and it is an object thereof to provide a speaker having a structure in which a voice coil with a small diameter and a voice coil with a large diameter are appropriately arranged within respective magnetic gaps, and a method of manufacturing the speaker.

It is another object of the present invention to provide a speaker capable of minimizing the mutual interference between the vibration by the voice coil with the small diameter and the vibration by the voice coil with the large diameter.

A speaker according to the present invention includes a diaphragm including an annular principal vibration part, an annular internal support for supporting the internal side of the principal vibration part, and an annular external support for supporting the external side of the principal vibration part; a large-diameter voice coil unit mounted at the outer edge of the principal vibration part of the diaphragm; a small-diameter voice coil unit mounted at the inner edge of the principal vibration part of the diaphragm; a magnetic circuit including a yoke having a magnet fixed thereto and forming a first magnetic gap where the large-diameter voice coil unit is to be arranged, and a second magnetic gap where the small-diameter voice coil unit is to be arranged, wherein the speaker includes a positioning member fixed to a central area and a peripheral area of the diaphragm as well as secured to a predetermined site of the magnetic circuit for restricting the positions of the diaphragm relative to the magnetic circuit in a radial direction and an axial direction perpendicular to the radial direction so that the large-diameter voice coil unit and the small-diameter voice coil unit are arranged within the first and second magnetic gaps, respectively.

By such a structure, the positioning member fixed to the diaphragm as well as secured to a predetermined site of the magnetic circuit restricts the position of the diaphragm relative to the magnetic circuit in a radial direction and an axial direction perpendicular to the radial direction so that the large-diameter voice coil unit and the small-diameter voice coil unit are arranged within the first and second magnetic gaps, respectively.

In the structure described above, the positioning member preferably includes a first positioning member bonded on the bottom surface of a flat part formed inside the annular internal support of the diaphragm for restricting the positions of the central part of the diaphragm in the radial direction and the axial direction; and a second positioning member bonded on the bottom surface of the outermost edge outwardly continued from the annular external support of the diaphragm for restricting the positions of the external periphery of the diaphragm in the radial direction and the axial direction.

By such a structure, the first positioning member and the second positioning member restrict the positions of both the central part and the external periphery of the diaphragm in the radial direction and the axial direction, so that the large-diameter voice coil unit and the small-diameter voice coil unit, which are mounted on the diaphragm, are securely arranged within the first and second magnetic gaps in the magnetic circuit, respectively.

In the structure described above, in the diaphragm, the stiffness of the principal vibration part preferably is less than the stiffness of the internal support and the external support. By such a structure, in the annular principal vibration part, the positions of the inner diameter (inner edge) and the outer diameter (outer edge) may have some variations; however, when the first and second positioning members are secured to the magnetic circuit, the positions of the internal support and the external support are accurately defined, so that in the principal vibration part with a stiffness less than the stiffness of the internal support and the external support, the positions of the inner diameter and the outer diameter are correctly set. Thereby, the positions of the large-diameter voice coil unit mounted at the outer edge of the principal vibration part and the small-diameter voice coil unit mounted at the inner edge of the principal vibration part are also set so that they are securely arranged within the first and second magnetic gaps, respectively.

Furthermore, in the structure described above, the stiffness of the internal support preferably is greater than that of the external support. By such a structure, the stiffness of the internal support inside the principal vibration part in the radial direction is greater than that of the external support outside the principal vibration part in the radial direction, so that the rigidity of the internal support is greater than that of the external support. Hence, the vibration of the small-diameter voice coil unit located close to the internal support with the higher rigidity can be smaller than that of the large-diameter voice coil unit located close to the external support with the lower rigidity, thereby reducing the influence of the vibration by the small-diameter voice coil unit on the vibration of the large-diameter voice coil unit. Also, since the rigidity of the internal support located close to the small-diameter voice coil unit is comparatively large, it is difficult for the vibration of the small-diameter voice coil unit to be affected by the vibration of the large-diameter voice coil unit.

The stiffness of the internal support and the external support may be varied by changing their respective shapes. Also, their stiffness may be varied by changing their respective materials. For example, the respective cross-sections of the internal support and the external support may be curved, and by reducing the curvature radius of the internal support to less than that of the external support, the stiffness of the internal support may be increased relative to that of the external support. By such a structure, even if the diaphragm composed of the principal vibration part, the internal support, and the external support is integrally made of the same material, the stiffness of the internal support can be increased relative to that of the external support.

A method of manufacturing a speaker according to the present invention includes a first step of fixing a positioning member for restricting the positions in a radial direction and an axial direction perpendicular to the radial direction of a diaphragm including an annular principal vibration part, an annular internal support for supporting the internal side of the principal vibration part in a radial direction, and an annular external support for supporting the external side of the principal vibration part in the radial direction, relative to a magnetic circuit including a yoke having a magnet fixed thereto; a second step of mounting a large-diameter voice coil unit at the outer edge of the principal vibration part of the diaphragm as well as mounting a small-diameter voice coil unit at the inner edge of the principal vibration part of the diaphragm; and a third step of integrating the diaphragm with the magnetic circuit so that the large-diameter voice coil unit and the small-diameter voice coil unit are arranged within magnetic gaps, respectively, by securing the positioning member fixed to the diaphragm at a predetermined site of the magnetic circuit.

By such a structure, after the positioning member for restricting the positions of the diaphragm relative to the magnetic circuit in the radial direction and the axial direction perpendicular to the radial direction is fixed to the diaphragm, by securing the positioning member at a predetermined site of the magnetic circuit, the diaphragm is integrated with the magnetic circuit so that the large-diameter voice coil unit and the small-diameter voice coil unit are arranged within the first and second magnetic gaps in the magnetic circuit, respectively. Thereby, the diaphragm can be easily integrated with the magnetic circuit so that the large-diameter voice coil unit and the small-diameter voice coil unit are arranged within their respective magnetic gaps.

In the speaker manufacturing method according to the present invention, the first step preferably includes bonding a first positioning member for restricting the positions of the central part of the diaphragm in the radial direction and the axial direction on the bottom surface of a flat part formed inside the annular internal support of the diaphragm; and bonding a second positioning member for restricting the positions of the external periphery of the diaphragm in the radial direction and the axial direction on the bottom surface of the outermost edge outwardly continued from the annular external support of the diaphragm, and the third step includes integrating the diaphragm with the magnetic circuit so that the large-diameter voice coil unit and the small-diameter voice coil unit are arranged within the magnetic gaps by securing the first positioning member at the central site of the magnetic circuit as well as retaining the second positioning member at an external peripheral site of the magnetic circuit.

By such a structure, the first positioning member and the second positioning member restrict the positions of both the central part and the external periphery of the diaphragm in the radial direction and the axial direction, so that the large-diameter voice coil unit and the small-diameter voice coil unit, which are mounted on the diaphragm, are securely arranged within the first and second magnetic gaps in the magnetic circuit, respectively.

According to the speaker of the present invention, the positioning member fixed to the diaphragm as well as secured at a predetermined site of the magnetic circuit restricts the positions of the diaphragm relative to the magnetic circuit in the radial direction and the axial direction perpendicular to the radial direction, and the diaphragm is integrated with the magnetic circuit so that the large-diameter voice coil unit and the small-diameter voice coil unit are arranged within the first and second magnetic gaps in the magnetic circuit, respectively. Thereby, the large-diameter voice coil unit and the small-diameter voice coil unit can be appropriately arranged within the first and second magnetic gaps, respectively.

According to the speaker of the present invention, the influence of the vibration by the small-diameter voice coil unit on the vibration by the large-diameter voice coil unit is reduced while it is difficult for the vibration of the small-diameter voice coil unit to be affected by the vibration of the large-diameter voice coil unit, so that the mutual interference between the vibration by the small-diameter voice coil unit and the vibration by the large-diameter voice coil unit is minimized. As a result, the distortion of frequency characteristics of output sound can be reduced as small as possible.

According to the speaker manufacturing method of the present invention, since the diaphragm can be easily integrated with the magnetic circuit so that the large-diameter voice coil unit and the small-diameter voice coil unit are arranged within their respective magnetic gaps, the speaker with a structure capable of appropriately arranging the large-diameter voice coil unit and the small-diameter voice coil unit within the magnetic gaps can be easily manufactured.

DESCRIPTION OF THE PREFERRED EMBODIMENTS

Figure 1:
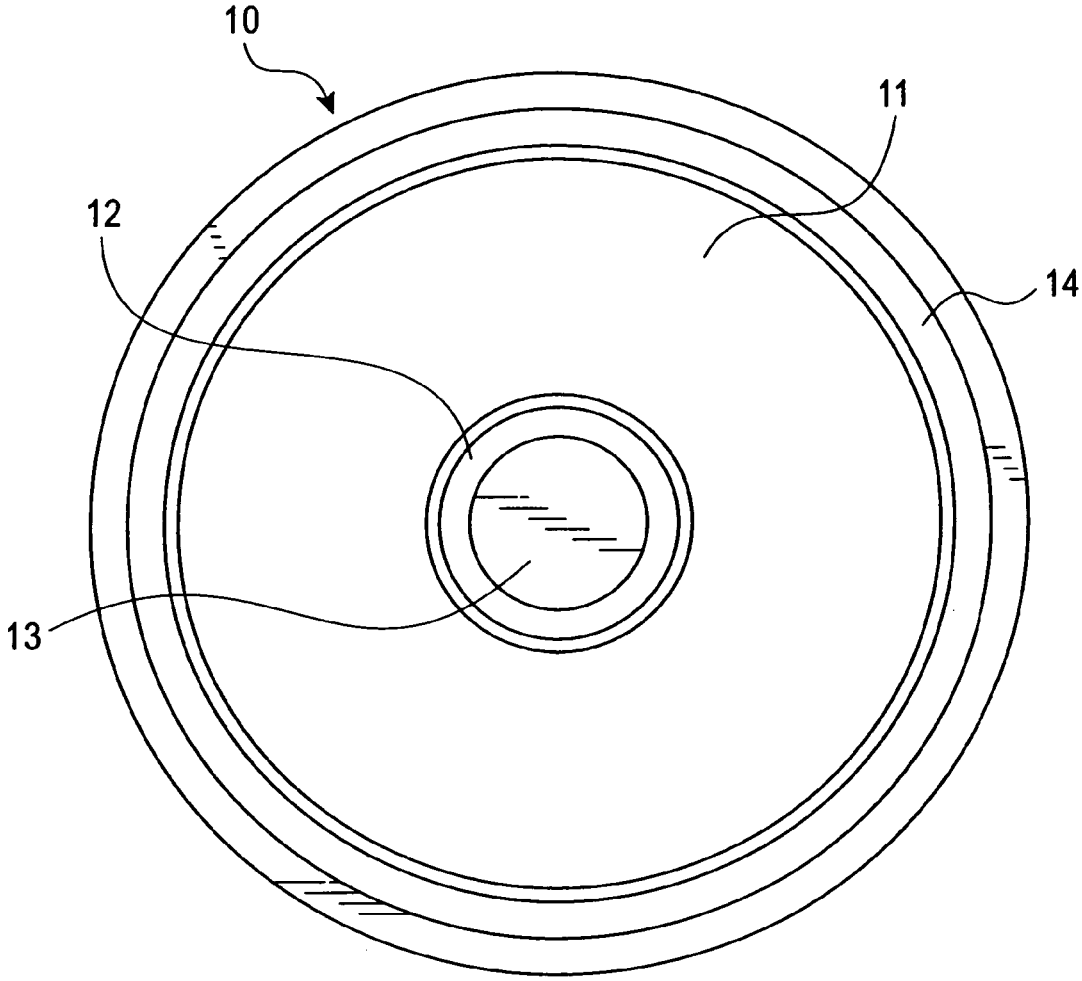
FIG. 1 is a plan view of a diaphragm according to an embodiment of the present invention.

Embodiments of the present invention will be described with reference to the drawings.

First, as shown in FIGS. 1 to 6, a diaphragm 10, formed of a synthetic resin, paper, or cloth, includes an annular principal vibration part 11, an annular internal support 12 for supporting the radially internal side of the principal vibration part 11, an annular external support 14 for supporting the radially external side of the principal vibration part 11, and a disk-like flat part 13 provided inside the internal support 12. The flat part 13 may also be an annular shape having a through-hole formed at the center. The respective sections of the principal vibration part 11, the internal support 12, and the external support 14 (see FIG. 2, for example) are curved to protrude in front of the speaker. The respective curvature radii of the principal vibration part 11, the internal support 12, and the external support 14 are established to have desired sound output characteristics.

The curvature radius of the principal vibration part 11 is distinctly larger than those of the internal support 12 and the external support 14, so that the stiffness of the principal vibration part 11 is lower in comparison with the internal support 12 and the external support 14. According to the embodiment, the principal vibration part 11, the internal support 12, and the external support 14 are integrally formed of the same material, and the curvature radius of the internal support 12 is set to be smaller than that of the external support 14, so that the stiffness of the internal support 12 is greater than that of the external support 14. The curvature radius of the principal vibration part 11 is set to be several times larger than that of the internal support 12 and the external support 14, so that almost all of the sound from this speaker is generated from the principal vibration part 11.

Next, the speaker manufacturing method according to the embodiment of the present invention will be described.

Figure 2:
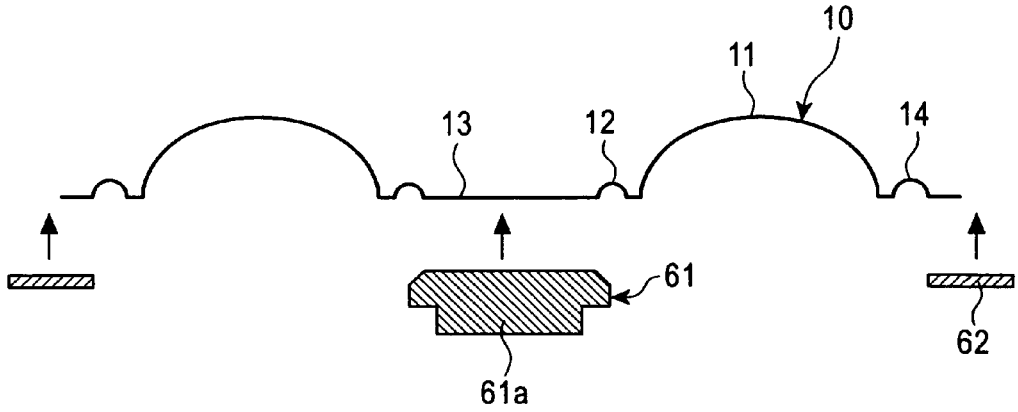
FIG. 2 is a drawing showing a first process step in a speaker manufacturing method according to the embodiment of the present invention.

A first process step of the speaker manufacturing method is shown in FIG. 2. In the first process step, an internal spacer 61 (a first positioning member) made of a synthetic resin is bonded on the bottom surface of the flat part 13 located at the center of the diaphragm 10. The internal spacer 61 is provided with a protrusion 61*a* formed on its surface opposite to the adhesion surface to the diaphragm 10 (the flat part 13). An external spacer 62 (a second positioning member) made of a synthetic resin is bonded on the bottom surface of an outermost edge outwardly continued from the external support 14 of the diaphragm 10.

Figure 3:
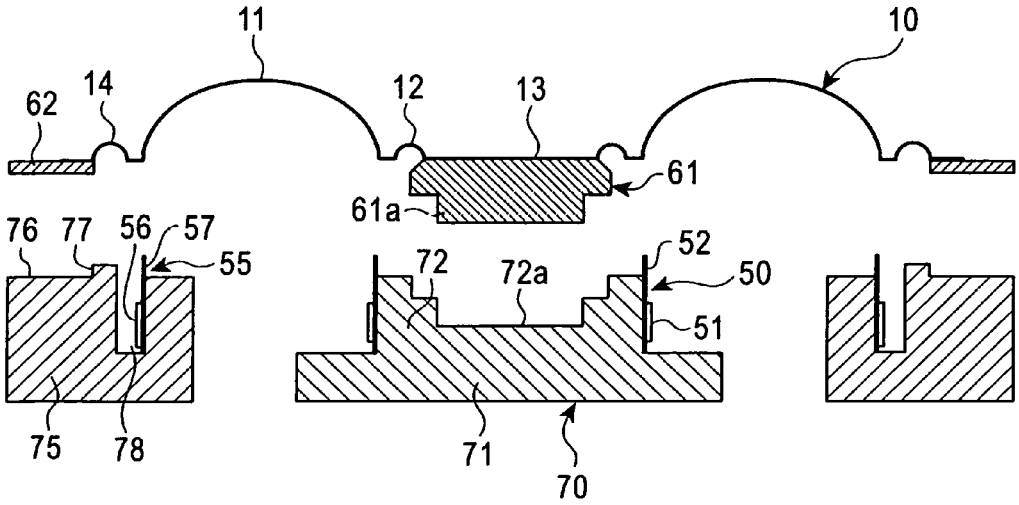
FIG. 3 is a drawing showing a second process step in the speaker manufacturing method according to the embodiment of the present invention.

A second process step of the speaker manufacturing method is shown in FIG. 3. In the second process step, on the diaphragm 10 having the internal spacer 61 and the external spacer 62 bonded thereon in the first process step, a small-diameter voice coil unit 50 and a large-diameter voice coil unit 55 are mounted.

A jig 70 includes a disk-like base plate 71 and a circular cylindrical support body 72 protruding from the center of the base plate 71. The outer diameter of the support body 72 is approximately the same as the inner diameter of the principal vibration part 11. The support body 72 is provided with a recess 72*a* formed on the upper surface thereof to be fitted to the internal spacer 61 mentioned above. A ring-shaped jig 75 has an annular groove 78 formed thereon. The inner diameter of the annular groove 78 is approximately the same as the outer diameter of the principal vibration part 11. The jig 75 is provided with a ring-shaped projection 77 formed on its upper end face and along the external periphery of the groove 78 and a support surface 76 formed outside the ring-shaped projection 77.

The small-diameter voice coil unit 50 has a structure in which a small-diameter voice coil 51 is wound at a predetermined position on a small-diameter bobbin 52 with an inner diameter approximately identical to the inner diameter of the principal vibration part 11 of the diaphragm 10. The large-diameter voice coil unit 55 has a structure in that a large-diameter voice coil 56 is wound at a predetermined position on a large-diameter bobbin 57 with an outer diameter approximately identical to the outer diameter of the principal vibration part 11 of the diaphragm 10. The small-diameter bobbin 52 of the small-diameter voice coil unit 50 is fitted to the external peripheral surface of the support body 72 of the jig 70 while the large-diameter bobbin 57 of the large-diameter voice coil unit 55 is fitted into the groove 78 of the jig 75 along the radially inward peripheral surface of the groove 78.

Figure 4:
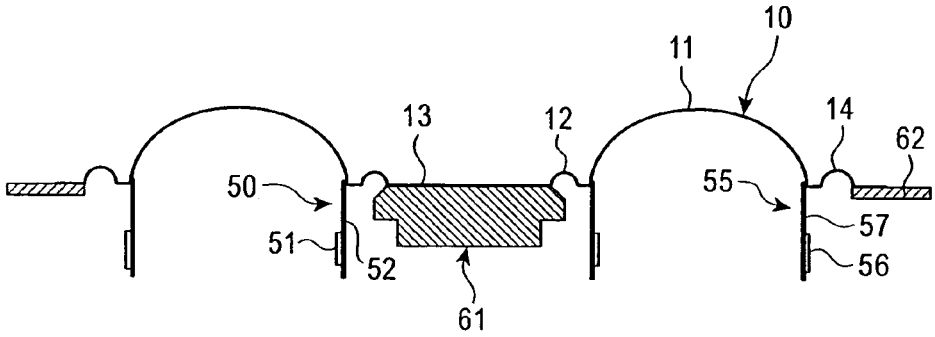
FIG. 4 is a sectional view of the structure of the diaphragm manufactured by the second process step.

In this state, the internal spacer 61 bonded on the diaphragm 10 is fitted and fixed into the recess 72*a* formed on the surface of the support body 72 of the jig 70 while the external spacer 62 bonded on the diaphragm 10 is fixed on the support surface 76 so that the inner edge of the external spacer 62 abuts the ring-shaped projection 77 of the jig 75. Thereby, as shown in FIG. 4, one end of the small-diameter bobbin 52 of the small-diameter voice coil unit 50 is abutted and bonded on the bottom inner edge of the principal vibration part 11. One end of the large-diameter bobbin 57 of the large-diameter voice coil unit 55 is abutted and bonded on the bottom outer edge of the principal vibration part 11.

Figure 5:
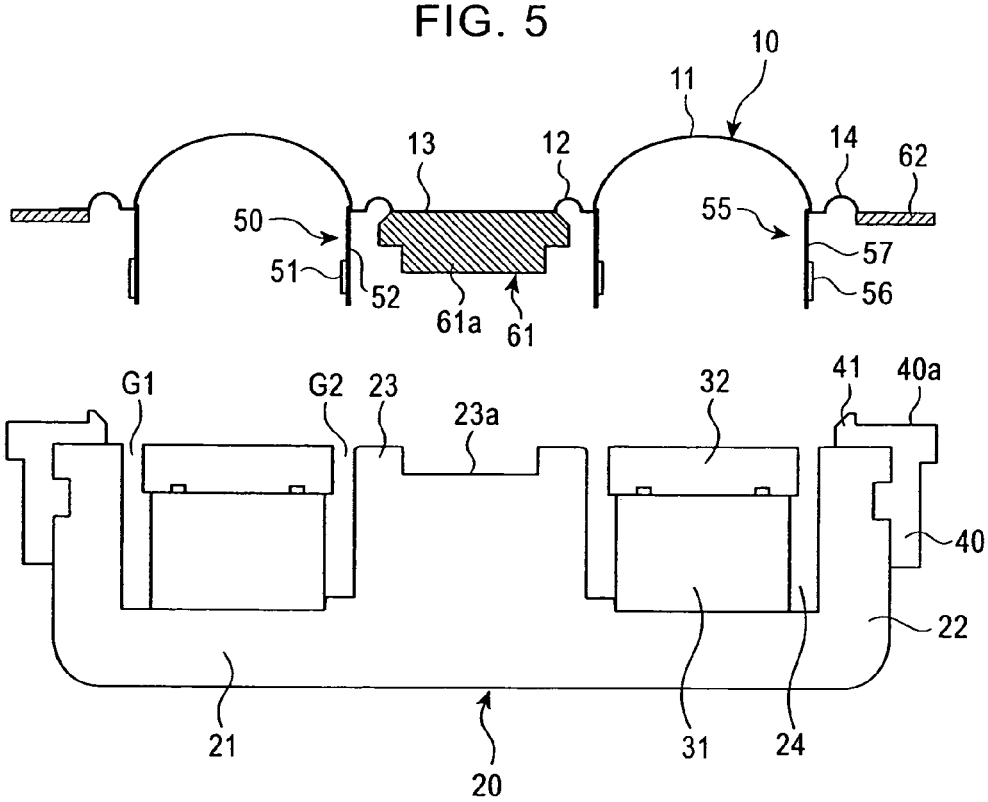
FIG. 5 is a drawing showing a third process step in the speaker manufacturing method according to the embodiment of the present invention.

A third process step of the speaker manufacturing method is shown in FIG. 5. In the third process step, as mentioned above, the yoke 20 is integrated with the diaphragm 10 having the internal spacer 61, the external spacer 62, the small-diameter voice coil unit 50, and the large-diameter voice coil unit 55 bonded thereon.

The yoke 20 is made of a magnetic material and includes a disk-like bottom part 21, a ring-shaped external peripheral wall 22 extending from the outer edge of the bottom part 21, and a central circular column 23 extending from the center of the bottom part 21. The central circular column 23 is provided with a recess 23*a* formed on its end face. Between the central circular column 23 and the external peripheral wall 22, an annular groove 24 is formed. Within the groove 24 of the yoke 20, a ring-shaped magnet 31 is provided so as to be fixed on the bottom part 21. An annular plate 32 made of a magnetic material is fixed on the end face of the magnet 31. Between the inner peripheral surface of the external peripheral wall 22 and the outer peripheral surface of the plate 32, which oppose each other, a first magnetic gap G1 is formed, while between the outer peripheral surface of the central circular column 23 and the inner peripheral surface of the plate 32, which oppose each other, a second magnetic gap G2 is formed. The yoke 20, the magnet 31, and the plate 32 constitute the magnetic circuit including the first and second magnetic gaps G1 and G2. At the front outer edge of the external peripheral wall 22 of the yoke 20, an annular diaphragm support 40 is mounted integrally with the magnetic circuit. The diaphragm support 40 is provided with a ring-shaped projection 41 formed on a support end face 40*a* radially inwardly. The outer diameter of the ring-shaped projection 41 is established to be approximately the same as the inner diameter of the external spacer 62.

In a state that the protrusion 61*a* of the internal spacer 61 bonded on the diaphragm 10 is fitted and secured in the recess 23*a* formed on the end face of the central circular column 23 while the inner edge of the external spacer 62 bonded on the diaphragm 10 is abutted and secured to the projection 41, the internal spacer 61 is bonded to the central circular column 23 while the external spacer 62 is bonded on the support end face 40*a* of the diaphragm support 40. By the fitting between the protrusion 61*a* and the recess 23*a* and by the abutment (fitting) between the inner edge of the external spacer 62 and the projection 41, the position of the diaphragm 10 relative to the yoke 20 is restricted in the radial direction (horizontal and vertical directions in FIG. 1). By the overall establishment of the thicknesses of the internal spacer 61, the external spacer 62, and the diaphragm support 40, the position of the diaphragm 10 relative to the yoke 20 is restricted in an axial direction (vertical direction in FIG. 6) perpendicular to the radial direction.

In the principal vibration part 11 with a large curvature radius, the positions of the inner diameter (inner edge) and the outer diameter (outer edge) may have some variations; however, when the internal spacer 61 is secured to the yoke 20 and the external spacer 62 is secured to the diaphragm support 40, the positions of the internal support 12 supported by the internal spacer 61 and the external support 14 supported by the external spacer 62 are accurately defined in the radial direction. Since the stiffness of the principal vibration part 11 is less than that of the internal support 12 and the external support 14, the positions of the inner diameter and the outer diameter are correctly set.

Figure 6:
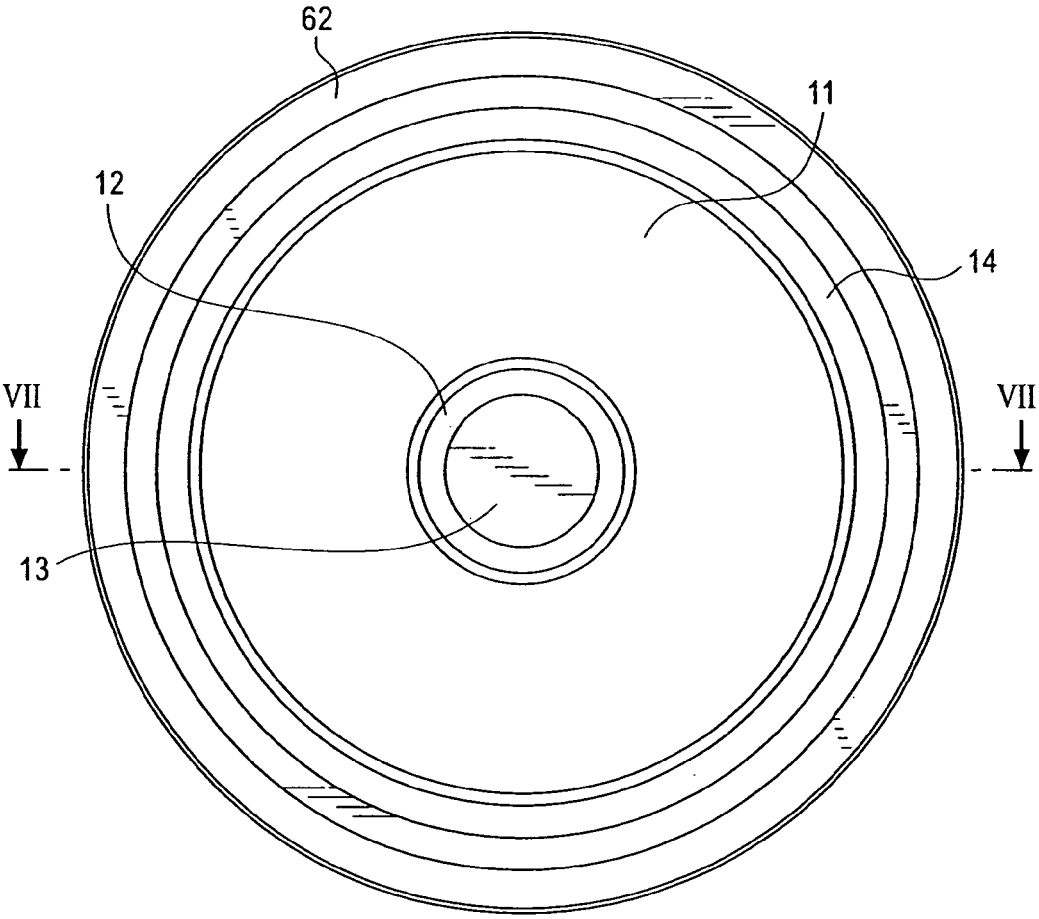
FIG. 6 is a plan view of the structure of the speaker manufactured by the speaker manufacturing method according to the embodiment of the present invention.
Figure 7:
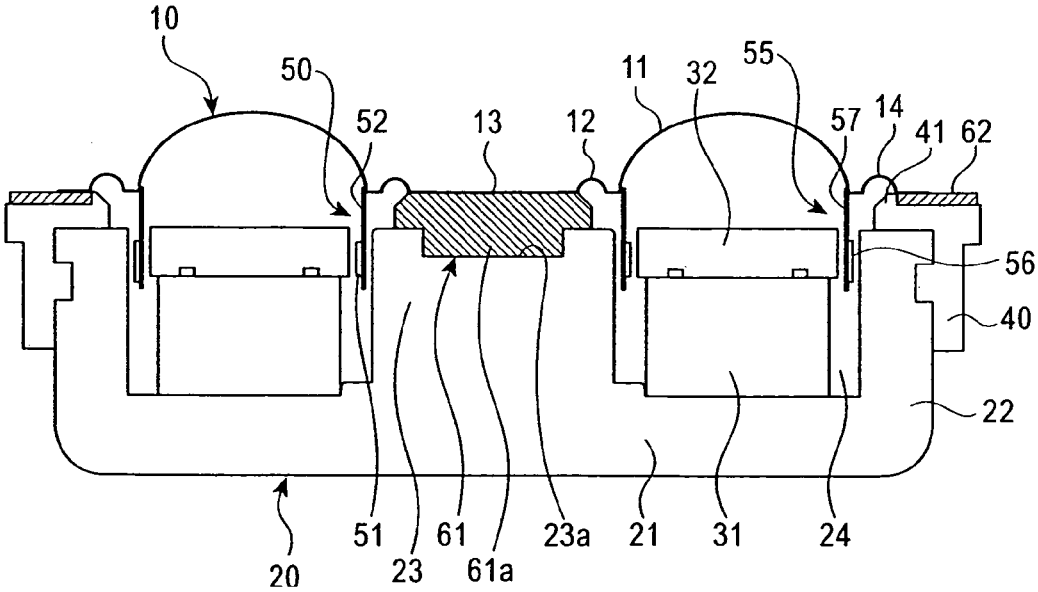
FIG. 7 is a sectional view at the line VII-VII of FIG. 6.

By the above-mentioned positional restriction of the diaphragm 10 relative to the yoke 20, as shown in FIG. 6, in a state that the small-diameter voice coil 51 is appropriately arranged within the second magnetic gap G2 between the external peripheral surface of the central circular column 23 of the yoke 20 and the internal peripheral surface of the plate 32, while the large-diameter voice coil 56 is appropriately arranged within the first magnetic gap G1 between the internal peripheral surface of the external peripheral wall 22 of the yoke 20 and the external peripheral surface of the plate 32, the diaphragm 10 is integrated with the yoke 20 (the magnetic circuit).

In the speaker manufacturing method described above, after the internal spacer 61 and the external spacer 62 for restricting the positions of the diaphragm 10 relative to the yoke 20 (the magnetic circuit) in the radial direction and the axial direction perpendicular to the radial direction are bonded on the diaphragm 10, by securing the internal spacer 61 to the central circular column 23 of the yoke 20 as well as securing the external spacer 62 to the diaphragm support 40 mounted on the external peripheral wall 22 of the yoke 20, the diaphragm 10 is integrated with the yoke 20 (the magnetic circuit) so that the large-diameter voice coil unit 55 and the small-diameter voice coil unit 50 are arranged within the first and second magnetic gaps G1 and G2 in the magnetic circuit, respectively. Thereby, the diaphragm 10 can be easily integrated with the yoke 20 (the magnetic circuit) so that the large-diameter voice coil unit 55 and the small-diameter voice coil unit 50 are arranged within the first and second magnetic gaps G1 and G2 in the magnetic circuit, respectively.

Furthermore, since the internal spacer 61 and the external spacer 62 restrict the positions of both the central part and the external periphery of the diaphragm 10 in the radial direction and the axial direction, the large-diameter voice coil unit 55 and the small-diameter voice coil unit 50, which are mounted on the diaphragm 10, are securely arranged within the first and second magnetic gaps G1 and G2 in the magnetic circuit, respectively.

In the speaker manufactured by the manufacturing method described above, the internal spacer 61 and the external spacer 62 restrict the positions of the diaphragm 10 relative to the yoke 20 (the magnetic circuit) in the radial direction and the axial direction perpendicular to the radial direction, thereby integrating the diaphragm 10 with the yoke 20 (the magnetic circuit) so that the large-diameter voice coil unit 55 and the small-diameter voice coil unit 50 are appropriately arranged within the first and second magnetic gaps G1 and G2 in the magnetic circuit, respectively.

According to the described embodiment, the external spacer 62 is secured to the yoke 20 (magnetic circuit) through the diaphragm support 40; however, a step portion capable of positioning the external spacer 62 on the front end face of the external peripheral wall 22 of the yoke 20 may be formed, and the external spacer 62 may also be bonded on the step portion directly.

In the speaker with the structure described above, upon applying an audio signal to the small-diameter voice coil 51 and the large-diameter voice coil 56, by a magnetic function with the magnetic circuit formed of the small-diameter voice coil 51, the large-diameter voice coil 56, the yoke 20, the magnet 31, and the plate 32, the small-diameter voice coil unit 50 and the large-diameter voice coil unit 55 vibrate in a front-back direction (an axial direction of each voice coil unit) in accordance with the signal waveform of the audio signal. By this vibration applied to the principal vibration part 11 of the diaphragm 10, the principal vibration part 11 vibrates integrally together with the internal support 12 and the external support 14. By such a vibration of the diaphragm 10 (the principal vibration part 11, the internal support 12, and the external support 14), a sound, such as a musical composition, is generated from the speaker in accordance with the audio signal. The vibration with a comparatively high frequency band, which can be generated by the small-diameter voice coil unit 50, is superimposed on the vibration with a comparatively low frequency band, which can be generated by the large-diameter voice coil unit 55, so as to have acoustic characteristics capable of obtaining a desired acoustic pressure.

The vibration of the diaphragm 10 described above will be described further in detail.

Since the stiffness of the internal support 12 is set to be greater than that of the external support 14, the rigidity of the internal support 12 is greater than that of the external support 14. Hence, the vibration of the small-diameter voice coil unit 50 located close to the internal support 12 with the higher rigidity is smaller than that of the large-diameter voice coil unit 55 located close to the external support 14 with the lower rigidity, thereby reducing the influence of the vibration by the small-diameter voice coil unit 50 on the vibration of the large-diameter voice coil unit 55. Also, since the rigidity of the internal support 12 located close to the small-diameter voice coil unit 50 is comparatively large, it is difficult for the vibration of the small-diameter voice coil unit 50 to be affected by the vibration of the large-diameter voice coil unit 55.

Figure 8:
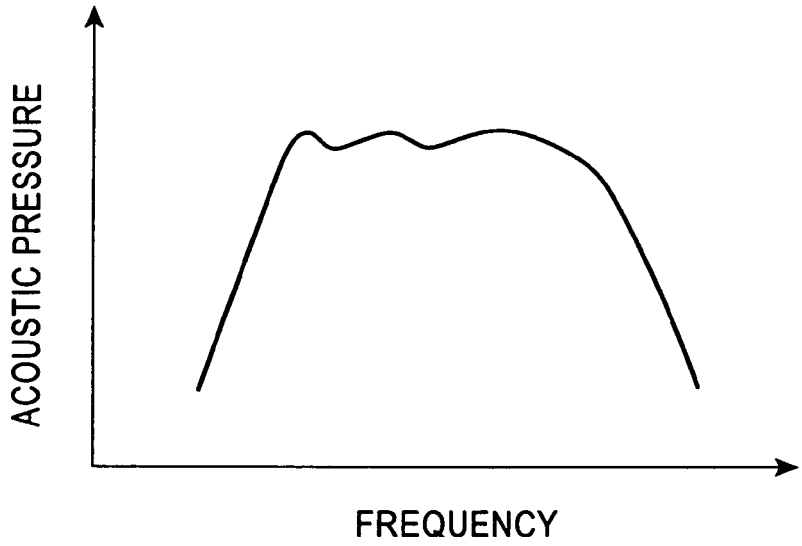
FIG. 8 is a graph showing the characteristic relationship between frequencies and acoustic pressure levels of the speaker shown in FIGS. 6 and 7.
Figure 9:
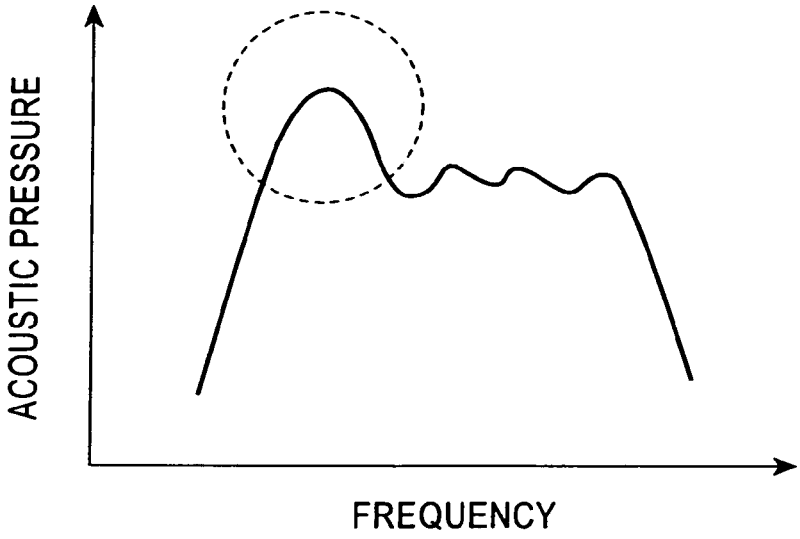
FIG. 9 PRIOR ART
FIG. 9 is a graph showing an example of the characteristic relationship between frequencies and acoustic pressure levels of a conventional speaker.

In such a manner, the influence of the vibration by the small-diameter voice coil unit 50 on the vibration by the large-diameter voice coil unit 55 is reduced while it is difficult for the vibration of the small-diameter voice coil unit 50 to be affected by the vibration of the large-diameter voice coil unit 55, so that the mutual interference between the vibration by the small-diameter voice coil unit 50 and the vibration by the large-diameter voice coil unit 55 is reduced. As a result, the resonance and the distortion due to the mutual interference between these vibrations can be suppressed, obtaining stable acoustic characteristics over a comparatively wide range of the frequency band, as shown in FIG. 8.

Even at a comparatively high frequency band, where the vibration amplitude is reduced, the acoustic pressure level is not substantially reduced in comparison with that at a comparatively low frequency band. Hence, although the vibration at a comparatively high frequency band by the small-diameter voice coil unit 50 is comparatively small, the acoustic pressure level required for that frequency level can be obtained.

According to the embodiment described above, by reducing the curvature radius of the internal support 12 to be smaller than that of the external support 14, the stiffness of the internal support 12 is greater than that of the external support 14; alternatively, the stiffness of the internal support 12 may be increased to be greater than that of the external support 14 by changing shapes other the curvature radius or by changing the material.

As described above, the speaker according to the present invention has advantages that the large-diameter voice coil unit and the small-diameter voice coil unit can be appropriately arranged within their respective magnetic gaps, and that the mutual interference between the vibration by the small-diameter voice coil unit and the vibration by the large-diameter voice coil unit can be minimized, reducing the distortion of frequency characteristics of output sound.

The speaker manufacturing method according to the present invention has an advantage that a speaker having two voice coils coaxially arranged with diameters different from each other can be easily manufactured.

While there has been illustrated and described what is at present contemplated to be preferred embodiments of the present invention, it will be understood by those skilled in the art that various changes and modifications may be made, and equivalents may be substituted for elements thereof without departing from the true scope of the invention. In addition, many modifications may be made to adapt a particular situation to the teachings of the invention without departing from the central scope thereof. Therefore, it is intended that this invention not be limited to the particular embodiments disclosed, but that the invention will include all embodiments falling within the scope of the appended claims.

What is claimed is:

1. A speaker comprising:

a diaphragm including an annular principal vibration part, an annular internal support for supporting the internal side of the principal vibration part, and an annular external support for supporting the external side of the principal vibration part;

a large-diameter voice coil unit mounted at the outer edge of the principal vibration part of the diaphragm;

a small-diameter voice coil unit mounted at the inner edge of the principal vibration part of the diaphragm;

a magnetic circuit including a yoke having a magnet fixed thereto and forming a first magnetic gap, where the large-diameter voice coil unit is arranged, and a second magnetic gap, where the small-diameter voice coil unit is arranged;

wherein the speaker includes a positioning member fixed to a central area and a peripheral area of the diaphragm and secured to a predetermined site of the magnetic circuit for restricting the positions of the diaphragm relative to the magnetic circuit in a radial direction and an axial direction perpendicular to the radial direction so that the large-diameter voice coil unit and the small-diameter voice coil unit are arranged within the first and second magnetic gaps, respectively; and wherein in the diaphragm, the stiffness of the principal vibration part is less than the stiffness of the internal support and the external support.

2. The speaker according to claim 1, wherein the positioning member includes:

a first positioning member fixed with respect to the innermost edge of the annular internal support of the diaphragm for restricting the positions of the central part of the diaphragm in the radial direction and the axial direction; and a second positioning member fixed with respect to the outermost edge of the annular external support of the diaphragm for restricting the positions of the external periphery of the diaphragm in the radial direction and the axial direction.

3. The speaker according to claim 1, wherein the stiffness of the internal support is greater than that of the external support.

4. The speaker according to claim 3, wherein the respective cross-sections of the internal support and the external support are curved, and the curvature radius of the internal support is set smaller than that of the external support so that the stiffness of the internal support is greater than that of the external support.

5. A speaker comprising:

a diaphragm including an annular principal vibration part, an annular internal support for supporting the internal side of the principal vibration part, and an annular external support for supporting the external side of the principal vibration part;

a large-diameter voice coil unit mounted at the outer edge of the principal vibration part of the diaphragm;

a small-diameter voice coil unit mounted at the inner edge of the principal vibration part of the diaphragm; and a magnetic circuit including a yoke having a magnet fixed thereto and forming a first magnetic gap, where the large-diameter voice coil unit is arranged, and a second magnetic gap, where the small-diameter voice coil unit is arranged, wherein the speaker includes:

a first positioning member bonded on the bottom surface of a part formed inside the annular internal support of the diaphragm for restricting the positions of the central part of the diaphragm in the radial direction and the axial direction; and a second positioning member bonded on the bottom surface of the outermost edge outwardly continued from the annular external support of the diaphragm for restricting the positions of the external periphery of the diaphragm in the radial direction and the axial direction; and wherein in the diaphragm, the stiffness of the principal vibration part is less than the stiffness of the internal support and the external support.

6. The speaker according to claim 5, wherein the stiffness of the internal support is greater than that of the external support.

7. The speaker according to claim 6, wherein the respective cross-sections of the internal support and the external support are curved, and the curvature radius of the internal support is set to be smaller than that of the external support so that the stiffness of the internal support is greater than that of the external support.

8. A speaker comprising:

a diaphragm including an annular principal vibration part, an annular internal support for supporting the internal side of the principal vibration part in a radial direction, and an annular external support for supporting the external side of the principal vibration part in the radial direction;

a large-diameter voice coil unit mounted at the outer edge of the principal vibration part of the diaphragm;

a small-diameter voice coil unit mounted at the inner edge of the principal vibration part of the diaphragm; and a magnetic circuit including a yoke having a magnet fixed thereto and forming a first magnetic gap, where the large-diameter voice coil unit is arranged, and a second magnetic gap, where the small-diameter voice coil unit is arranged, wherein in the diaphragm, the stiffness of the principal vibration part is less than the stiffness of the internal support and the external support, and wherein the speaker includes a positioning member fixed to a central area and a peripheral area of the diaphragm and secured to a predetermined site of the magnetic circuit for restricting the positions of the diaphragm relative to the magnetic circuit in a radial direction and an axial direction perpendicular to the radial direction so that the large-diameter voice coil unit and the small-diameter voice coil unit are arranged within the first and second magnetic gaps, respectively.

9. The speaker according to claim 8, wherein the positioning member includes:

a first positioning member bonded on the bottom surface of a flat part formed inside the annular internal support of the diaphragm for restricting the positions of the central part of the diaphragm in the radial direction and the axial direction; and a second positioning member bonded on the bottom surface of the outermost edge outwardly continued from the annular external support of the diaphragm for restricting the positions of the external periphery of the diaphragm in the radial direction and the axial direction.

10. The speaker according to claim 8, wherein the stiffness of the internal support is greater than that of the external support.

11. The speaker according to claim 10, wherein the respective cross-sections of the internal support and the external support are curved, and the curvature radius of the internal support is set to be less than that of the external support so that the stiffness of the internal support is greater than that of the external support.

* * * * *